US010433611B2

(12) United States Patent
Chen

(10) Patent No.: US 10,433,611 B2
(45) Date of Patent: Oct. 8, 2019

(54) BICYCLE HELMET

(71) Applicant: GIANT MANUFACTURING CO., LTD., Taichung (TW)

(72) Inventor: Chih-Yang Chen, Taichung (TW)

(73) Assignee: GIANT MANUFACTURING CO., LTD., Taichung (TW)

( * ) Notice: Subject to any disclaimer, the term of this patent is extended or adjusted under 35 U.S.C. 154(b) by 169 days.

(21) Appl. No.: 15/630,971

(22) Filed: Jun. 23, 2017

(65) Prior Publication Data

US 2018/0368503 A1 Dec. 27, 2018

(51) Int. Cl.

*A42B 3/06* (2006.01)
*A42B 3/28* (2006.01)
*A42B 3/04* (2006.01)

(52) U.S. Cl.

CPC ..... *A42B 3/066* (2013.01); *A42B 3/0493* (2013.01); *A42B 3/281* (2013.01)

(58) Field of Classification Search

CPC ..... A42B 3/28; A42B 3/0493; A42B 3/281; A42B 3/066; A42B 3/283; A42B 3/124; A42B 3/065; A42B 3/062; A42B 3/06

See application file for complete search history.

(56) References Cited

U.S. PATENT DOCUMENTS 4,115,874 A * 9/1978 Hasegawa ..... A42B 3/281 2/171.3
4,519,099 A * 5/1985 Kamiya ..... A42B 3/281 2/171.3
D293,496 S * 12/1987 Gentes ..... A42B 3/0493 D29/102
4,903,350 A 2/1990 Gentes et al.
5,023,958 A 6/1991 Rotzin
5,450,631 A 9/1995 Egger
5,551,094 A 9/1996 Navone
6,105,176 A 8/2000 Egger
6,263,513 B1 * 7/2001 Murakami ..... A42B 3/0493 2/171.3
9,414,636 B2 8/2016 Pietrzak
2013/0340151 A1 12/2013 Bradley et al.
2014/0298570 A1 * 10/2014 Cobb ..... A42B 3/0493 2/410
2015/0272254 A1 * 10/2015 Hamel ..... A42B 3/0493 2/425

* cited by examiner

*Primary Examiner* — Amy Vanatta
(74) *Attorney, Agent, or Firm* — CKC & Partners Co., LLC

(57) ABSTRACT

A bicycle helmet includes a body, a plurality of air inlets and a plurality of air outlets. The body includes a front portion, an upper portion, a rear portion and an inner portion. The upper portion includes a closed surface. A plurality of dimple structures are formed on the closed surface to produce an aerodynamic effect. The air inlets are formed on the front portion. The air outlets are formed on the rear portion. The inner portion includes a plurality of ribs, the ribs are positioned correspondingly to the air inlet and the air outlet and define air channels therein, an airflow flows through the body due to the airflow entering the body through the air inlets, passing through the air channels and exiting the body through the air outlets.

14 Claims, 10 Drawing Sheets

BICYCLE HELMET

BACKGROUND

Technical Field

The present disclosure relates to a helmet. More particularly, the present disclosure relates to a bicycle helmet.

Description of Related Art

A helmet is often recognized as an important gear for protecting the head of a wearer. In some specified vehicles, such as motorcycles, bicycles and racing cars, the helmet has become indispensable equipment, whether in a general or serious use condition.

Many efforts have been made to understand the relationship between the head injury and the bicycle riding, and to develop helmet that can provide more safety when an impact occurred to the wearer's head.

There are increasing demands on the functionalities of the bicycle helmet, particularly for the competitive bicycles. The bicycle helmet is not only required to provide adequate protection from serious head injury; desirably the bicycle helmet is also required to have lightweight and is aerodynamically configured for reducing the wind resistance. Moreover, the bicycle helmet is also required to provide comfort of wear. All of the functionalities are required to be highly integrated in the structure of the bicycle helmet. Therefore, there is a need to develop a bicycle helmet that has high safety as well as diversified functionalities.

SUMMARY

According to one aspect of the present disclosure, a bicycle helmet is provided. The bicycle helmet includes a body, a plurality of air inlets and a plurality of air outlets. The body includes a front portion, an upper portion, a rear portion and an inner portion. The upper portion includes a closed surface, and a plurality of dimple structures are formed on the closed surface to produce an aerodynamic effect. The air inlets are formed on the front portion, and the air outlets are formed on the rear portion. The inner portion includes a plurality of ribs; the ribs are positioned correspondingly to the air inlets and the air outlets and define air channels therein. An airflow flows through the body due to the airflow entering the body through the air inlets, passing through the air channels and exiting the body through the air outlets.

BRIEF DESCRIPTION OF THE DRAWINGS

The present disclosure can be more fully understood by reading the following detailed description of the embodiment, with reference made to the accompanying drawings as follows.

DETAILED DESCRIPTION

It is an objective of the present disclosure to provide a novel bicycle helmet which is aerodynamically streamlined, lightweight and has a great amount of cooling airflow to pass between the wearer's head and the inside of the helmet.

Another object of the present disclosure is to provide a bicycle helmet that can ensure a minimum movement between the body of the bicycle helmet and the wear's head thereby providing sufficient protection effect.

Figure 1:
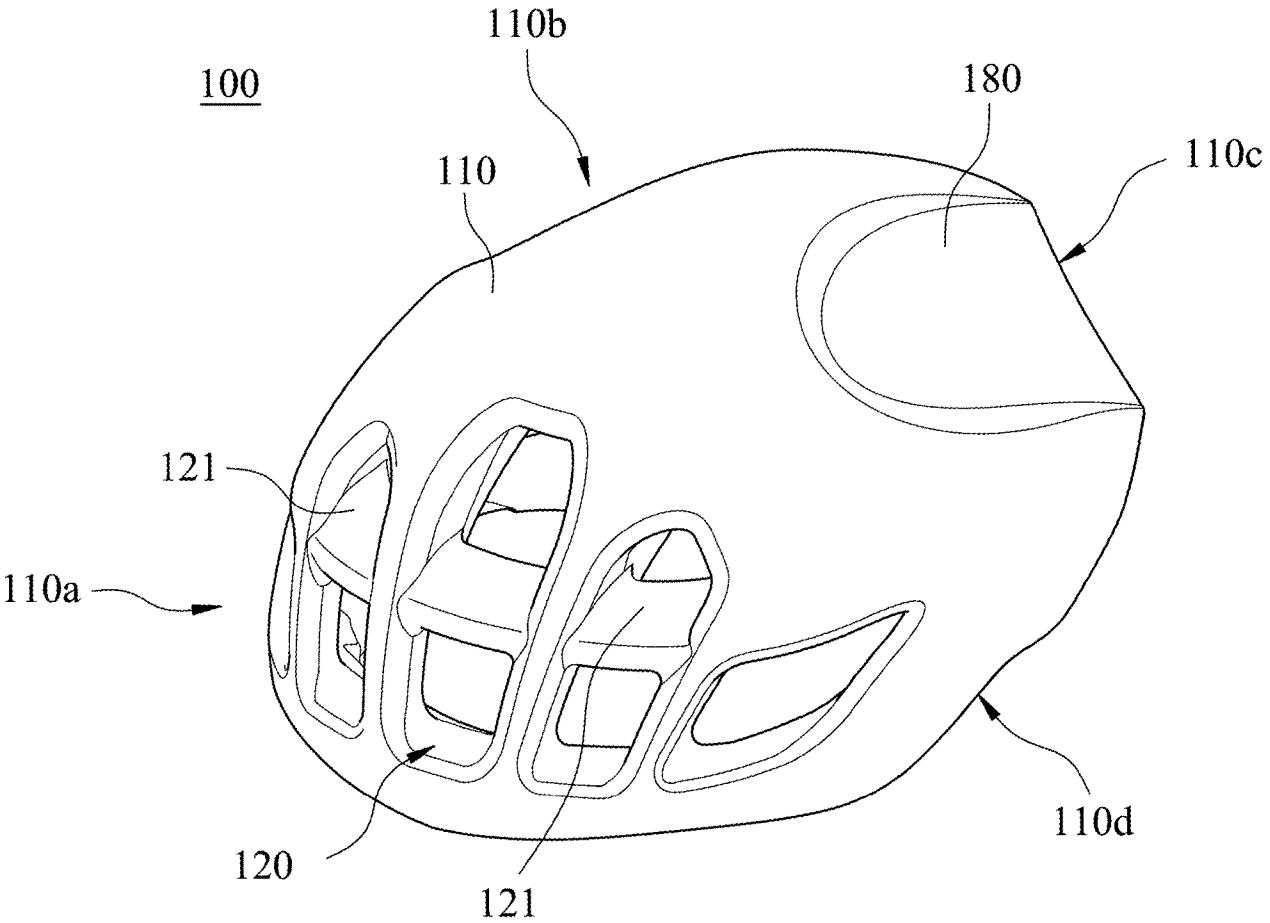
FIG. 1 is a schematic view of a bicycle helmet according to one embodiment of the present disclosure.
Figure 2:
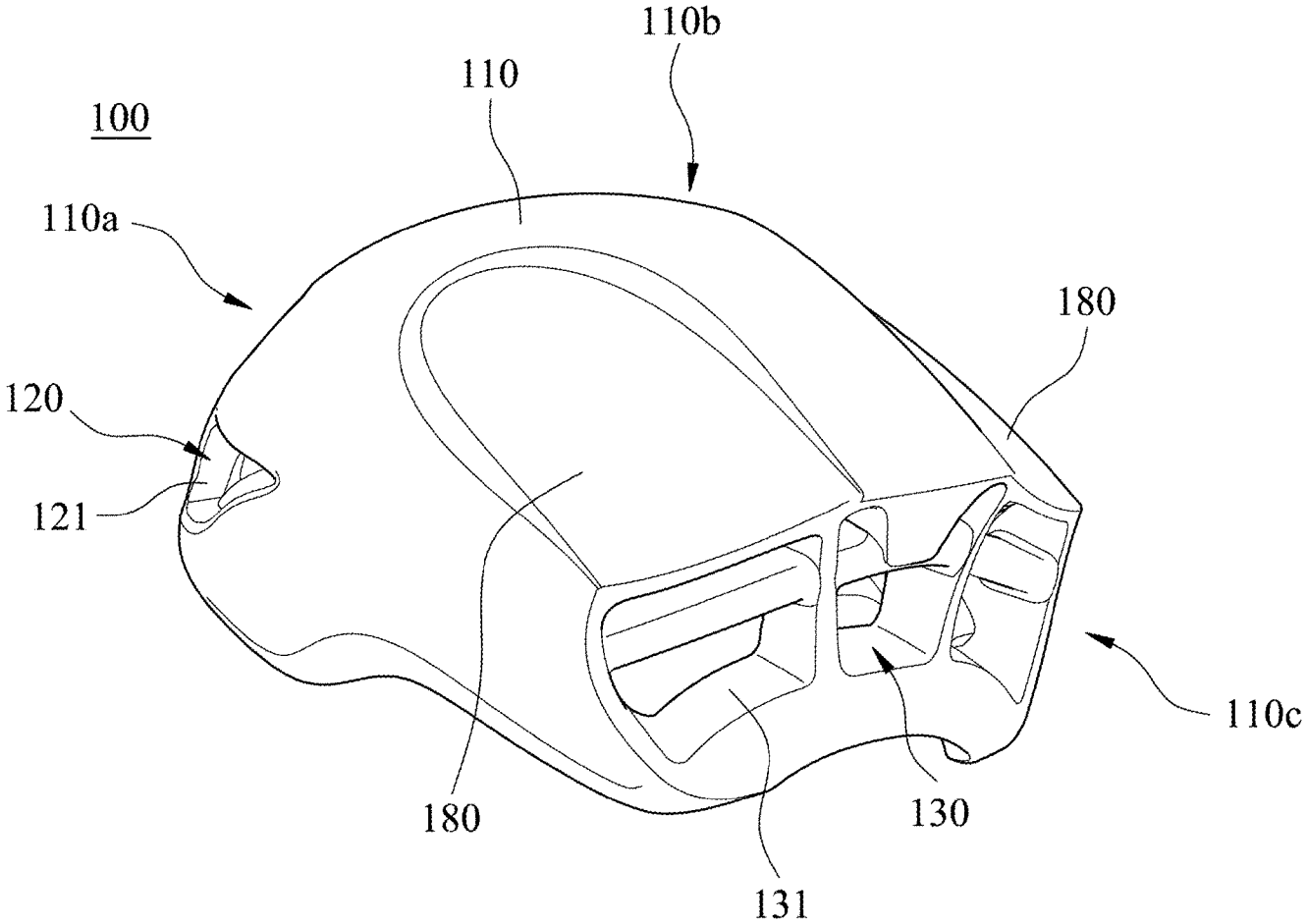
FIG. 2 is a schematic view of the bicycle helmet of FIG. 1 viewed from another viewing angle.
Figure 3:
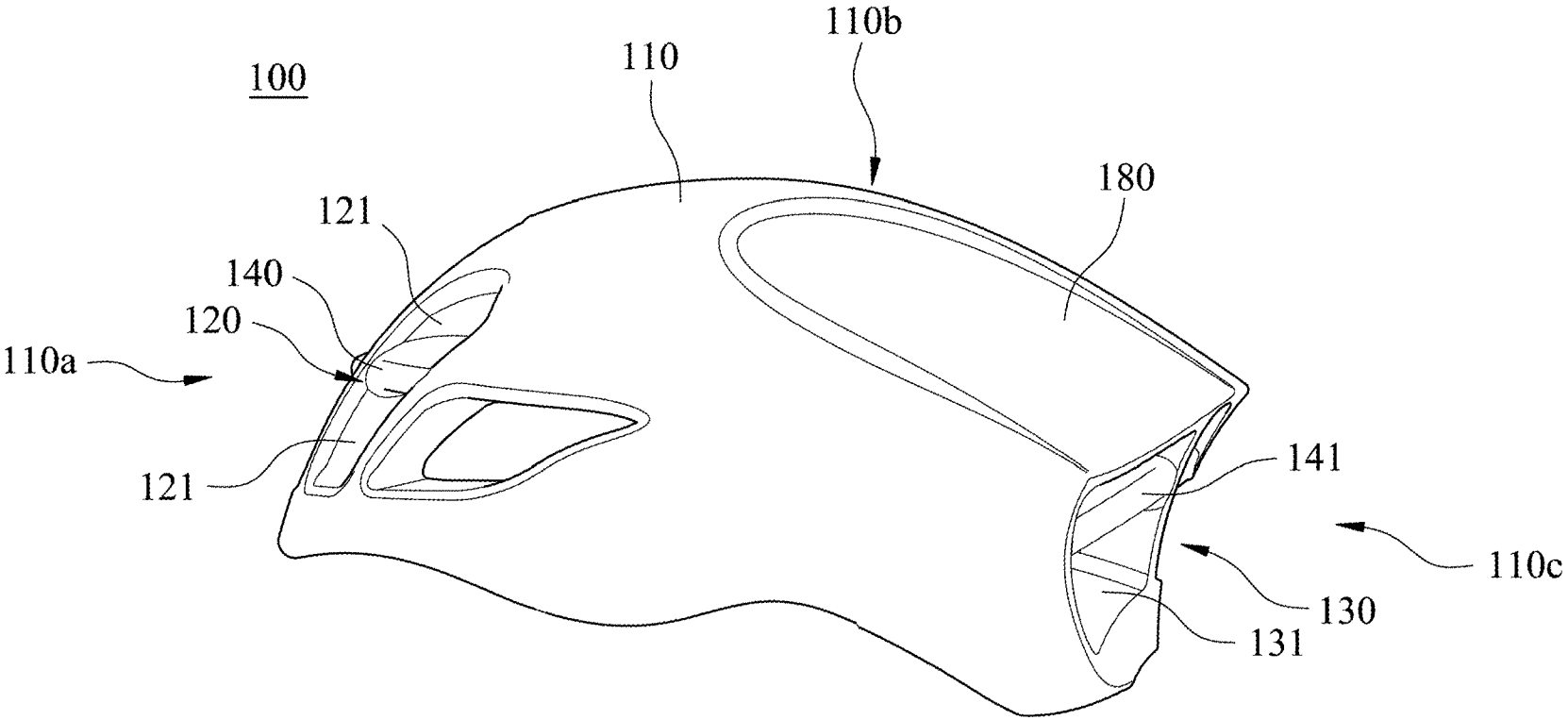
FIG. 3 is a side view of the bicycle helmet of FIG. 1.
Figure 4:
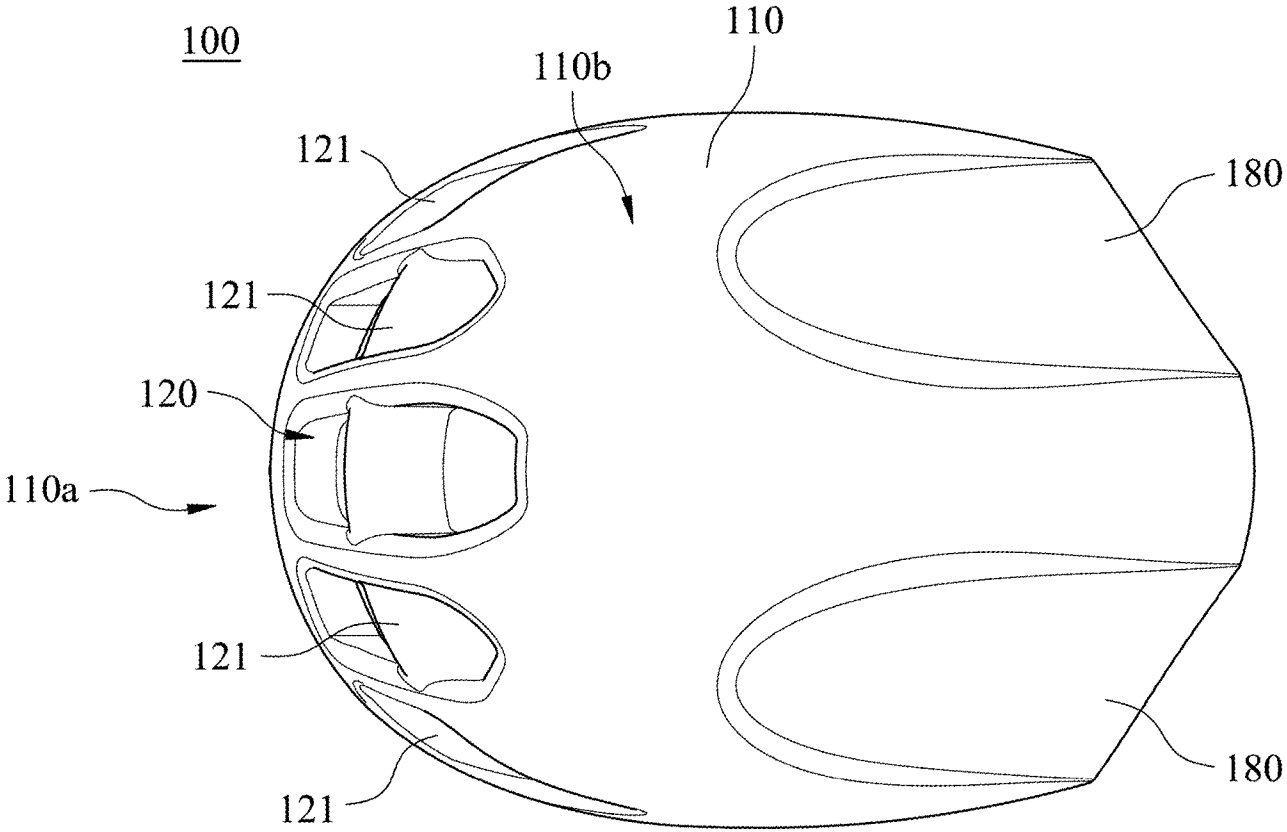
FIG. 4 is a top view of the bicycle helmet of FIG. 1.
Figure 5:
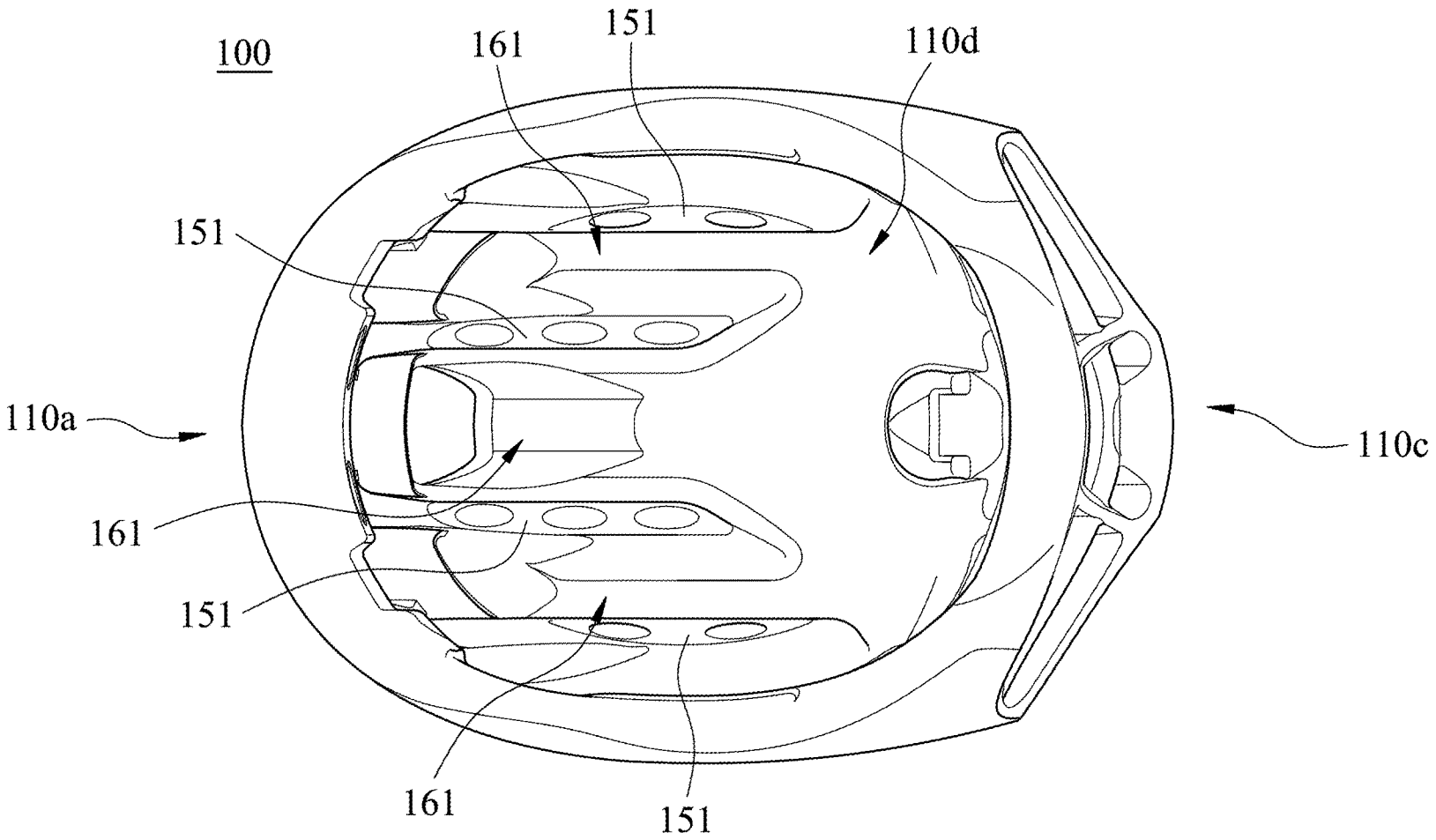
FIG. 5 is a bottom view of the bicycle helmet of FIG. 1.
Figure 6:
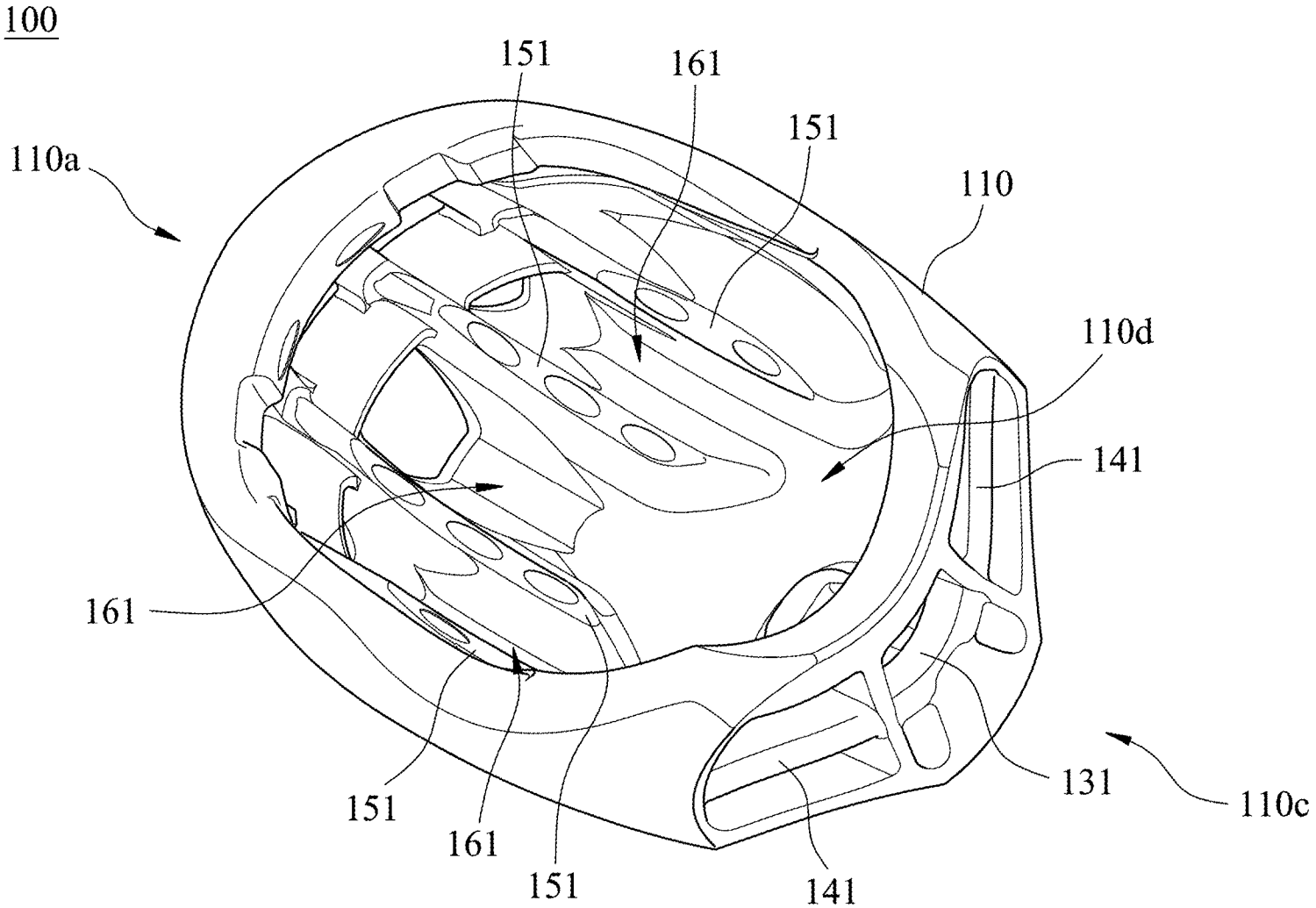
FIG. 6 shows another viewing angle of the bicycle helmet of FIG. 5.
Figure 7:
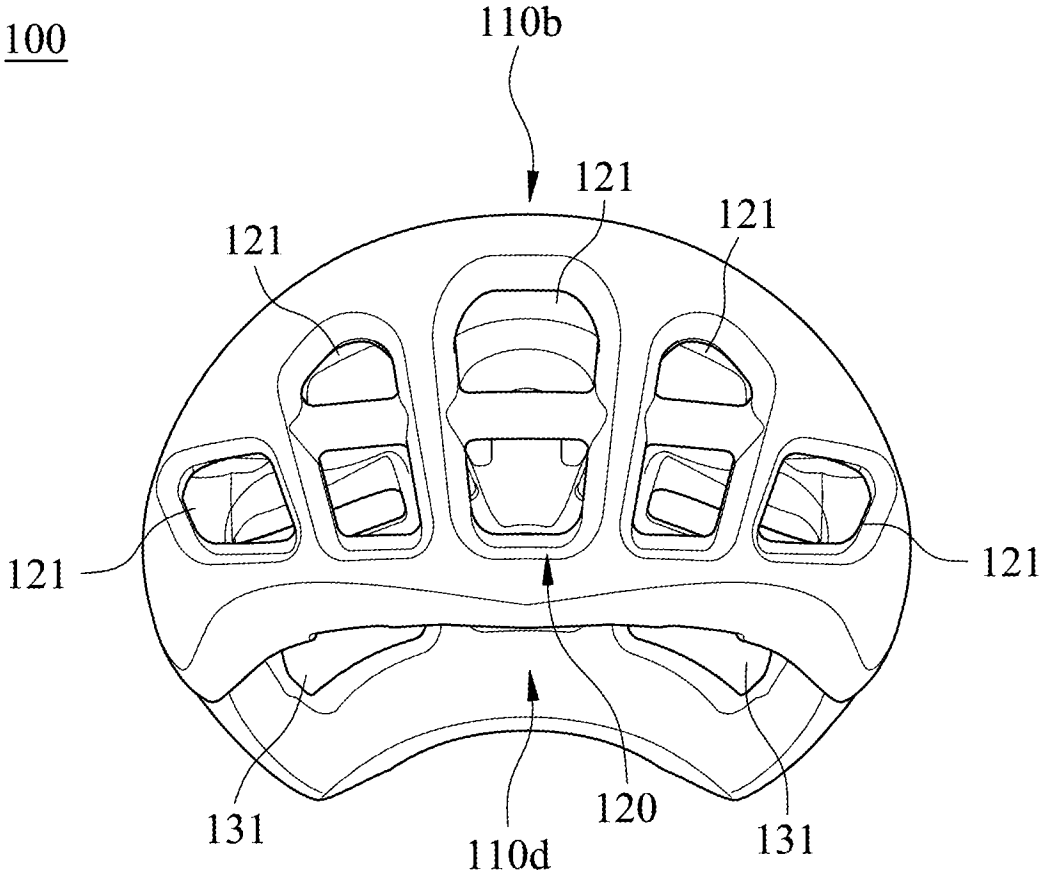
FIG. 7 is a rear view of the bicycle helmet of FIG. 1.
Figure 8:
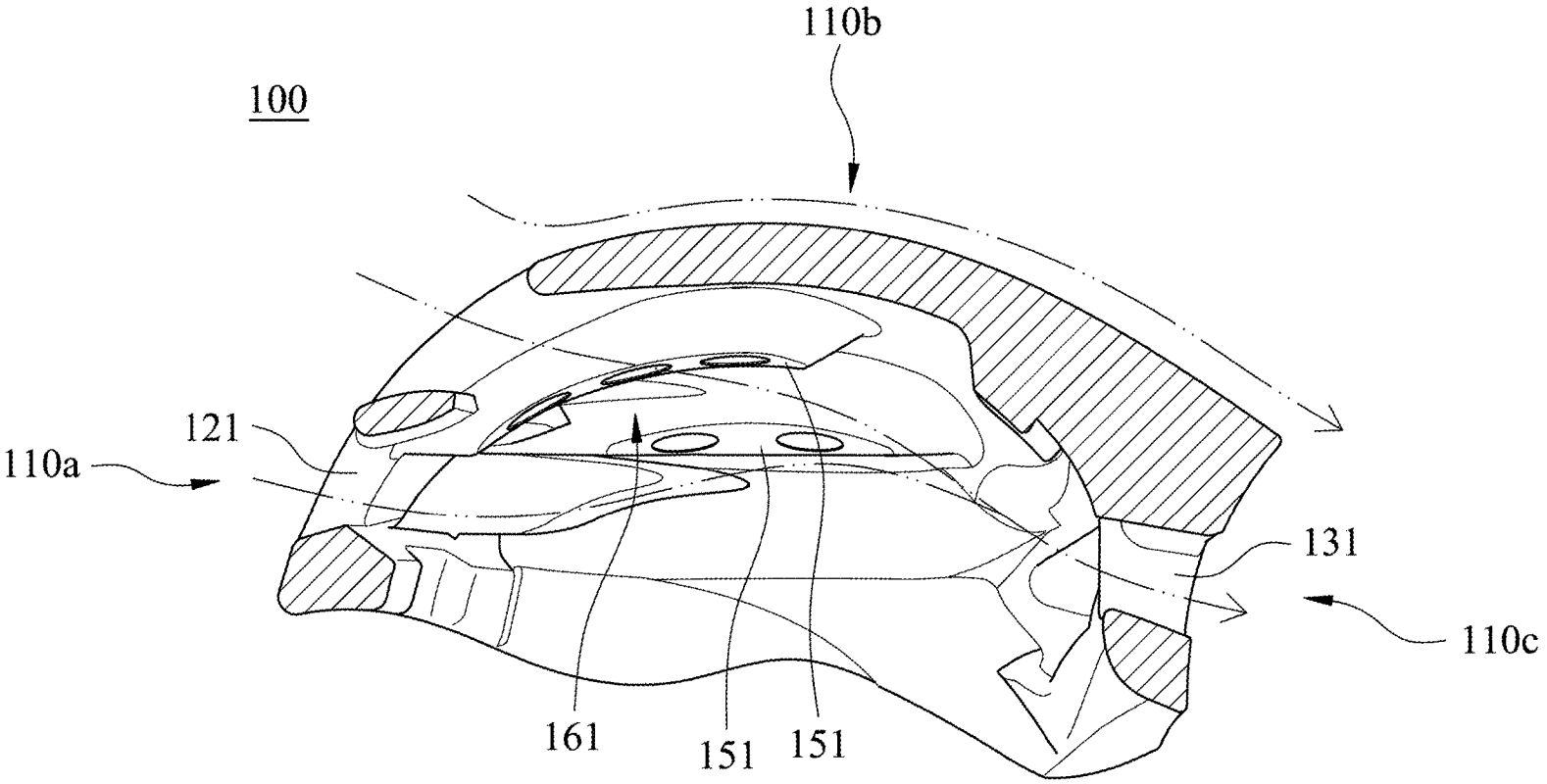
FIG. 8 is a cross-sectional view of the bicycle helmet of FIG. 1.

A preferred embodiment of the present disclosure referring to FIGS. 1-8. FIG. 1 is a schematic view of a bicycle helmet 100 according to one embodiment of the present disclosure; FIG. 2 is a schematic view of the bicycle helmet 100 of FIG. 1 viewed from another viewing angle; FIG. 3 is a side view of the bicycle helmet 100 of FIG. 1; FIG. 4 is a top view of the bicycle helmet 100 of FIG. 1; FIG. 5 is a bottom view of the bicycle helmet 100 of FIG. 1; FIG. 6 shows another viewing angle of the bicycle helmet 100 of FIG. 5; FIG. 7 is a rear view of the bicycle helmet 100 of FIG. 1; and FIG. 8 is a cross-sectional view of the bicycle helmet 100 of FIG. 1.

A bicycle helmet 100 includes a body 110, a plurality of air inlets 120 and a plurality of air outlets 130. The body 110 includes a front portion 110*a*, an upper portion 110*b*, a rear portion 110*c* and an inner portion 110*d*. The upper portion 110*b* includes a closed surface, and a plurality of dimple structures 180 are formed on the closed surface to produce an aerodynamic effect. As can be seen in FIGS. 1-4, the dimple structures 180 are U-shaped and are formed extendedly from two sides of a middle portion to two sides of a rear portion of the closed surface. Therefore, the closed surface having aerodynamic dimple structures 180 can provide higher stability and reduce wind resistance while bicycle riding.

The material of the body 110 can be polymers, such as PETG or other thermoset polymers.

The air inlets 120 are formed on the front portion 110*a* and the air outlets are formed on the rear portion 110*c*.

An airflow can flow through the body 110 for providing an air-cooling effect. In other words, the airflow enters the body 110 through the air inlets 120 and exits the body 110 through the air outlets 130.

For allowing the airflow to flow through, each of the air inlets 120 and each of the air outlets 130 includes at least one opening 121, 131. It should be mentioned that the number of the openings 121, 131 can be varied with different considerations on aerodynamics. The openings 121, 131 can be formed by disposing supporting frames 140, 141 in the air inlets 120 or the air outlets 130.

In FIG. 7 and FIG. 8, some of the openings 121 of the air inlets 120 and some of the openings 131 of the air outlet 131 are positioned correspondingly. Through the arrangement of the openings 121, 131, the airflow is allowed to enter from the air inlets 120 and to exit from the air outlets 130 and can be broadly distributed around inside of the bicycle helmet 100.

From FIGS. 1 to 4, it is shown that the upper portion 110*b* is closed (i.e. the upper portion 110*b* has a closed surface).

Therefore, the strength of the bicycle helmet 100 can be enhanced thereby providing better protection effect.

In FIG. 5 and FIG. 6, the inner portion 110*d* includes a concave shape for receiving a wearer's head. The inner portion 110*d* includes a plurality of ribs 151, each of ribs 151 is disposed separately, and a gap 161 is formed between each of the ribs 151. The gaps 161 provide sufficient air channels that enhance the air-cooling effect. In more detail, the ribs 151 are positioned correspondingly to the air inlets 120 of the front portion 110*a* and the air outlets 130 of the rear portion 110*c* and define air channels therein. Therefore, in FIG. 8, the airflow enters the body 110 through the air inlets 120, passes through the air channels and exits the body 110 through the air outlets 130. Moreover, each of the ribs 151 is connected between the front portion 110*a* and the rear portion 110*c* to enhance the strength of the bicycle helmet 100 thereby providing better protection effect to the wearer's head. Furthermore, the arrangement of the spaced ribs 151 is favorable for a comfortable wearing as well as reducing the weight of the bicycle helmet 100.

Furthermore, the rear portion 110*c* has a cut section that is cut from an extension direction of the closed surface of the upper portion 110*b*. The cut section can provide better protection effect of the back head of the wearer.

Figure 9:
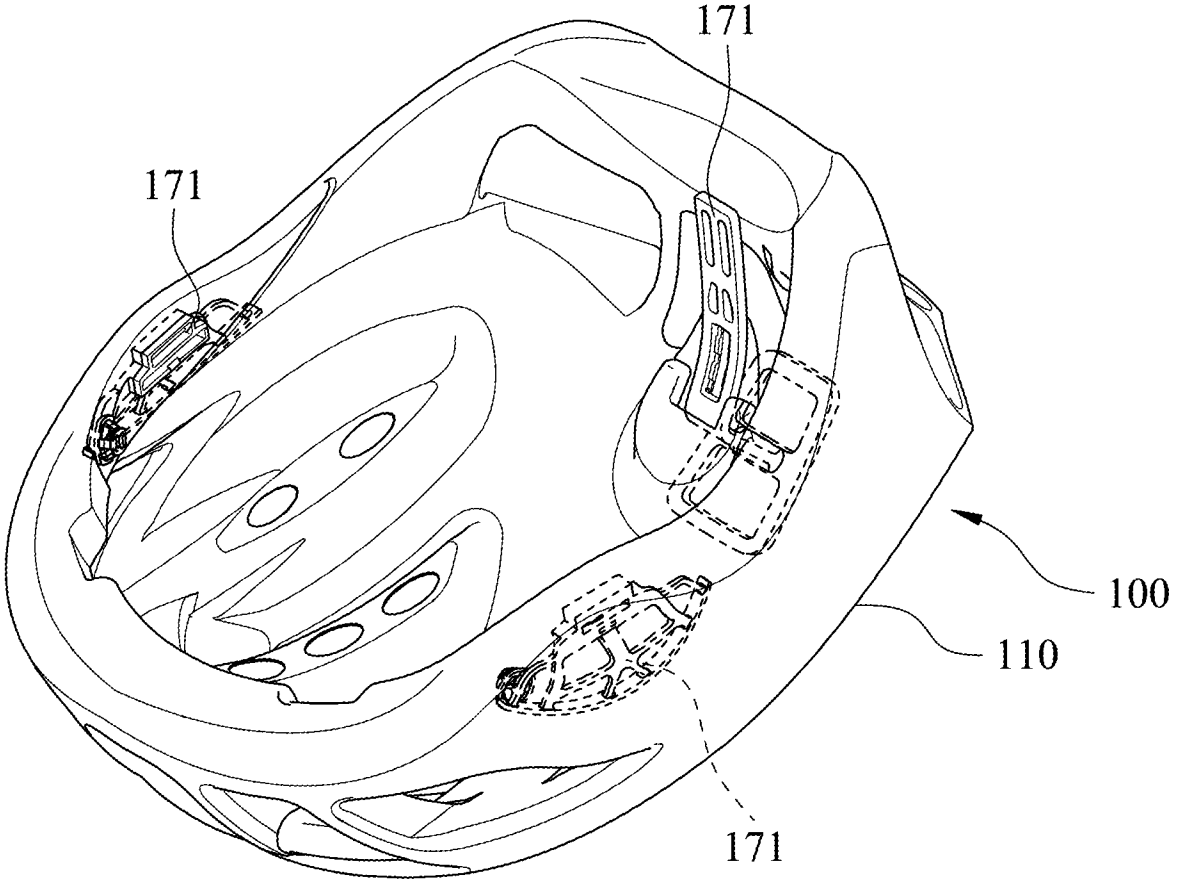
FIG. 9 shows a chinstrap clamping mechanism of the bicycle helmet of FIG. 1.
Figure 10:
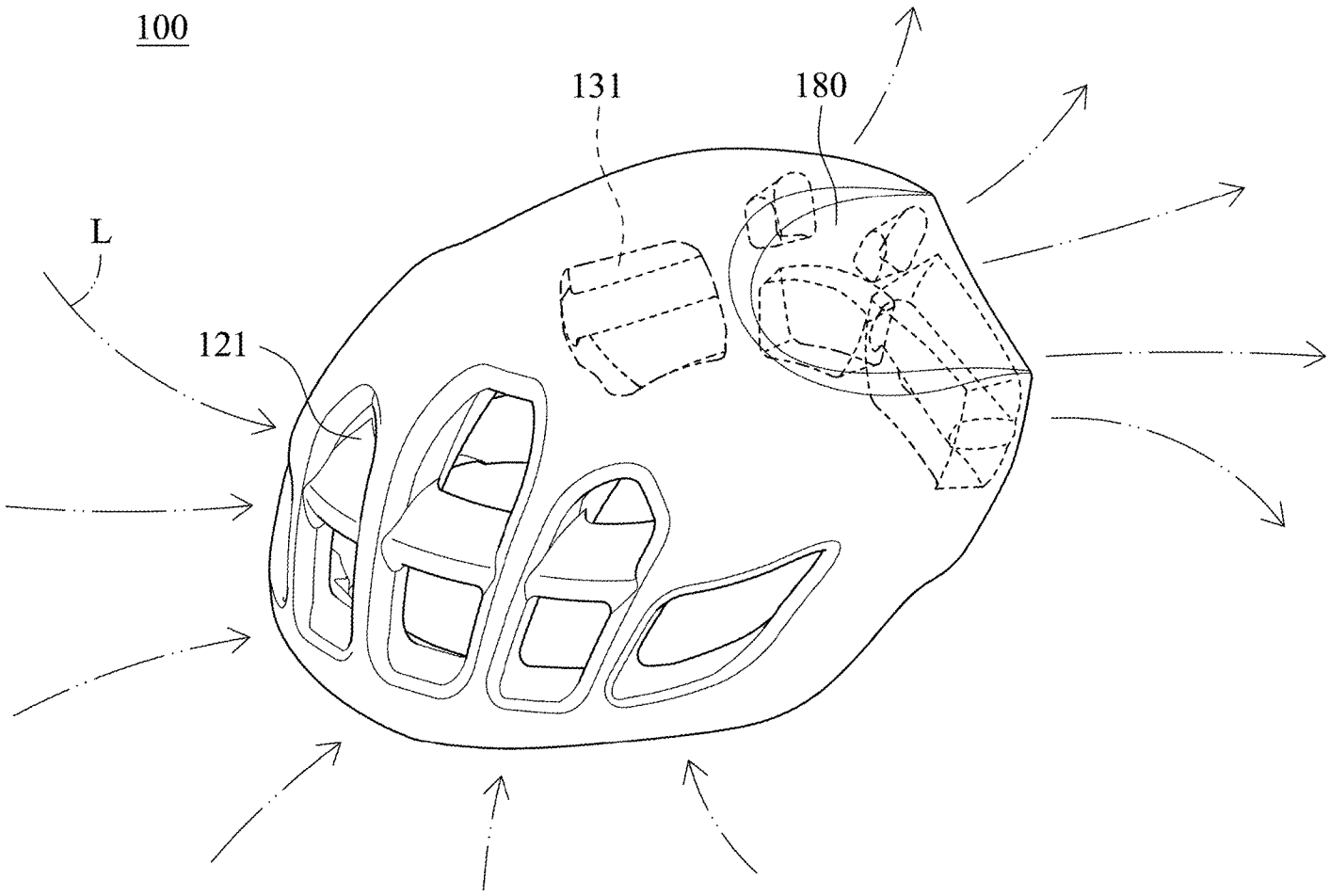
FIG. 10 shows the airflow flows from the openings of the front portion and the openings of the rear portions of the bicycle helmet of FIG. 1.

FIG. 9 shows a chinstrap clamping mechanism 171 of the bicycle helmet 100 of FIG. 1; and FIG. 10 shows the airflow L flows from the openings 121 of the front portion 110*a* and the openings 131 of the rear portion 110*c* of the bicycle helmet 100 of FIG. 1.

In FIG. 9, a chinstrap clamping mechanism 171 is disposed on two sides of the body 110. A chinstrap (not shown) is commonly used to securely fasten the wearer's head to the inner portion 110*d* of the bicycle helmet 100. The chinstrap clamping mechanism 171 provides an adjustable arrangement of the chinstrap. In one embodiment, the chinstrap passes down from the body 110 in front of and behind the ear on each side of the wearer's head and that meet in front of and beneath the wearer's ears and pass around the chin of the wearer.

In FIG. 10, an airflow L is shown. The airflow L passes through the openings 121 of the air inlets 120 of the front portion 110*a* and through the wearer's forehead. Then, the airflow L passes through the top and side of the wearer's head to provide broad distribution of the air over and around the wearer's head beneath the bicycle helmet 100. Then, the airflow L exits from the openings 131 of the air outlet 130 of the rear portion 110*c*. The airflow L can provide sufficient air-cooling effect as well as heat dissipation effect while riding the bicycle.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A bicycle helmet comprising:

a body comprising a front portion, an upper portion, a rear portion and an inner portion, the upper portion comprising a closed surface and two dimple structures each having a U-shape and formed on the closed surface to produce an aerodynamic effect, wherein the body has a length extending from the front portion thereof to the rear portion thereof, the closed surface comprises a front part, a middle part and a rear part arranged along a direction of the length, the two dimple structures are located at two sides of the closed surface, respectively, and each of the two dimple structures starts from the middle part along the direction of the length toward the rear part and ends at a rear edge of the upper portion;

a plurality of air inlets formed on the front portion; and a plurality of air outlets formed on the rear portion;

wherein the inner portion comprises a plurality of ribs, the ribs are positioned correspondingly to the air inlets and the air outlets and define air channels therein, an airflow flows through the body due to the airflow entering the body through the air inlets, passing through the air channels and exiting the body through the air outlets.

2. The bicycle helmet of claim 1, wherein each of the air inlets comprises at least one opening for allowing the airflow to flow through, and each of the air outlets comprises at least one opening for allowing the airflow to flow through.

3. The bicycle helmet of claim 2, wherein at least one of the air inlets comprises a supporting frame, and at least one of the air outlets comprises a supporting frame.

4. The bicycle helmet of claim 2, wherein at least one of the openings of the air inlets is longitudinally aligned to at least one of the openings of the air outlets.

5. The bicycle helmet of claim 1, wherein the inner portion comprises a concave shape for receiving a wearer's head.

6. The bicycle helmet of claim 1, wherein the rear portion protrudes downwardly from the rear edge of the upper portion and is substantially perpendicular to the rear edge.

7. The bicycle helmet of claim 1, wherein each of the ribs is disposed separately.

8. The bicycle helmet of claim 7, wherein each of the ribs is positioned correspondingly to the air inlets and the air outlets and is connected between the front portion and the rear portion.

9. The bicycle helmet of claim 1, further comprising a chinstrap clamping mechanism disposed on two sides of the body.

10. The bicycle helmet of claim 1, wherein:

the air inlets comprise a plurality of front air inlets disposed side by side to form a grouping of the front air inlets;

each of the front air inlets has a length and a width;

an air inlet supporting frame is formed in each of the front air inlets extending in a direction of and fully traversing the width of said each of the front air inlets; and each of the front air inlets is divided into a pair of air inlet openings by the air inlet supporting frame formed therein.

11. The bicycle frame of claim 10, wherein the air inlets further comprise a pair of side air inlets disposed respectively on opposite sides of the grouping of the front air inlets.

12. The bicycle frame of claim 10, wherein a direction of the length of each of the front air inlets is approximately in the direction of the length of the body.

13. The bicycle frame of claim 1, wherein:

the air outlets comprise a pair of outer air outlets, and a center air outlet interposed between the outer air outlets;

each of the outer air outlets has a length and a width;

an air outlet supporting frame is formed in each of the outer air outlets extending in a direction of and fully traversing the length of said each of the outer air outlets; and each of the outer air outlets is divided into a pair of air outlet openings by the air outlet supporting frame formed therein.

14. The bicycle frame of claim 13, wherein a height intersects the length of the body and extends from a bottom of the body to an uppermost part of a top of the body, and a direction of the width of each of the outer air outlets is approximately in a direction of the height of the body.

* * * * *